US010436188B2

(12) United States Patent
Sharp et al.

(10) Patent No.: US 10,436,188 B2
(45) Date of Patent: Oct. 8, 2019

(54) COMPRESSOR SHROUD HAVING INTEGRAL MUFFLER AND INERTIAL FILTER

(71) Applicant: MAT INDUSTRIES, LLC, Long Grove, IL (US)

(72) Inventors: Thomas B. Sharp, Jackson, TN (US); Mark W. Wood, Cedar Grove, TN (US); Jeremy D. Leasure, Jackson, TN (US)

(73) Assignee: MAT INDUSTRIES, LLC, Long Grove, IL (US)

( * ) Notice: Subject to any disclaimer, the term of this patent is extended or adjusted under 35 U.S.C. 154(b) by 511 days.

(21) Appl. No.: 14/699,192

(22) Filed: Apr. 29, 2015

(65) Prior Publication Data

US 2015/0316050 A1 Nov. 5, 2015

Related U.S. Application Data

(60) Provisional application No. 61/986,138, filed on Apr. 30, 2014.

(51) Int. Cl.

| | |
|---|---|
| ***F04B 39/16*** | (2006.01) |
| ***F04B 53/00*** | (2006.01) |
| ***F04B 35/04*** | (2006.01) |
| ***F04B 53/20*** | (2006.01) |
| ***F04B 39/00*** | (2006.01) |
| ***F04B 39/12*** | (2006.01) |

(52) U.S. Cl.

CPC ..... *F04B 39/16* (2013.01); *F04B 35/04* (2013.01); *F04B 39/0061* (2013.01); *F04B 39/121* (2013.01); *F04B 53/004* (2013.01); *F04B 53/20* (2013.01)

(58) Field of Classification Search

CPC ..... F04B 39/0055; F04B 39/0061; F04B39/121; F04B 39/16; F04B 53/004; F04B 11/0091; F04B 17/03; F04B 17/06; F04B 19/20; F04B 19/22; F04B 35/04; F04B 35/06; F04B 37/10; F04B 39/0027; F04B 39/005; F04B 39/06; F04B 39/12; F04B 39/125; F04B 41/00; F04B 53/001; F04B 53/007; F04B 53/08; F04B 53/16; F04B 53/20

USPC ..... 417/312, 313, 321, 360, 366, 368, 371, 417/410.1, 415, 540, 542

See application file for complete search history.

(56) References Cited

U.S. PATENT DOCUMENTS

| | | | | |
|---|---|---|---|---|
| 5,137,434 A | | 8/1992 | Wheeler et al. | |
| 5,252,035 A | * | 10/1993 | Lee | F04B 39/0044 181/403 |
| 6,682,317 B2 | * | 1/2004 | Chen | F04B 35/04 417/312 |
| 6,991,436 B2 | * | 1/2006 | Beckman | F04B 39/066 417/201 |

(Continued)

*Primary Examiner* — Kenneth J Hansen

*Assistant Examiner* — Chirag Jariwala

(74) *Attorney, Agent, or Firm* — Greer, Burns & Crain, Ltd.

(57) ABSTRACT

A pneumatic compressor is provided and includes a cylinder head having a first muffler cavity for drawing an intake air. Also included in the compressor is a compressor shroud including an inertial filter having a filter slot, and an integral muffler, wherein the inertial filter and the integral muffler are integrally formed within the compressor shroud.

11 Claims, 2 Drawing Sheets

(56) References Cited

U.S. PATENT DOCUMENTS

| | | | | |
|---|---|---|---|---|
| 8,899,378 | B2 * | 12/2014 | Wood | F04B 23/10<br>181/229 |
| 2005/0140233 | A1 * | 6/2005 | Kojima | F04D 25/0653<br>310/156.37 |
| 2006/0104833 | A1 * | 5/2006 | Hueppchen | F04B 39/066<br>417/372 |

* cited by examiner

COMPRESSOR SHROUD HAVING INTEGRAL MUFFLER AND INERTIAL FILTER

CROSS-REFERENCE

This application claims priority of U.S. Provisional Application Ser. No. 61/986,138, filed Apr. 30, 2014 under 35 U.S.C. § 119(e), which is incorporated herein by reference.

BACKGROUND

The present disclosure generally relates to pneumatic compressors, and more particularly relates to an air compressor used for supplying compressed air to a pneumatic tool.

Conventional pneumatic compressors use an inertial filter configured to be disposed within a cylinder head using an inlet port tube(s). U.S. Pat. No. 5,137,434 discloses, for example, an air compressor assembly for providing ambient air flows at a predetermined velocity using one or more intake or inlet ports to the compressor, where some portions of the ambient air flows are diverted into the intake port. Specifically, the portions of the air flowing over a valve plate assembly and over the cylinder head are diverted into an air intake for the compressor.

The diverted air abruptly changes flow directions from the remainder of the air by positioning baffles in the air compressor assembly. Any dust and other particles dispersed in the flow of cooling air have sufficient inertia that they tend to continue moving with the cooling air rather than change direction and enter the inlet ports. As a result, the inlet air is filtered through inertia, and the compressor and an associated motor are cooled by the air flows. Further, the cooling air increases the life of motor and compressor components, such as an air hose and reduces the burn risk for a user of the compressor. However, while this type of inertial filter can be an effective air filter, an inlet muffler size and its effectiveness is limited by a size of the cylinder head.

Other conventional compressors use a portion of a compressor shroud and an additional partial muffler enclosure having the inlet tube for forming an enclosed inlet muffler cavity. Although this type of compressor shroud provides an effective inlet tube and muffler cavity at a cost of only a partial muffler cavity, the muffler cavity is divided into two different regions in the compressor assembly. Specifically, one half of the muffler cavity is located in the cylinder head, and the other half of the muffler cavity is located in a separate housing piece for forming the enclosed inlet muffler cavity. This type of two-stage muffler is also limited by the size of the cylinder head.

Thus, there is a need for developing an improved compressor shroud having both the inertial filter and the muffler cavity that are not limited by the size of the cylinder head.

SUMMARY

The present disclosure is directed to a compressor shroud having an inertial filter and an integral muffler, both of which are fully enclosed within the compressor shroud. The present compressor shroud provides both the inertial filter and the integral muffler without having to include additional, separate parts in the compressor shroud. One aspect of the present compressor shroud is that, as described in further detail below, the inertial filter can be positioned either upstream or downstream of a motor fan. This shroud configuration also provides support and sealing features for an additional second muffler tube connecting an enclosed muffler cavity in the shroud to an inlet port of a cylinder head.

Another important aspect is that the muffler is integral with the compressor shroud, and includes a cavity barrier configured for accommodating at least one muffler cavity within the compressor shroud. Each muffler cavity is defined by at least one baffle, the shroud, and the cavity barrier. This muffler configuration generates about ten times larger muffler cavity at a significantly lower cost, and thus provides more efficient and compact muffling than conventional compressor shrouds.

In one embodiment, a pneumatic compressor is provided and includes a cylinder head having a first muffler cavity for drawing an intake air. Also included in the compressor is a compressor shroud including an inertial filter having a filter slot, and an integral muffler, wherein the inertial filter and the integral muffler are integrally formed within the compressor shroud.

In another embodiment, a pneumatic compressor is provided and includes a cylinder head having a first muffler cavity for drawing an intake air. Also included in the compressor is a compressor shroud including an inertial filter having a filter slot, and an integral muffler, wherein the inertial filter and the integral muffler are integrally formed within the compressor shroud. A cooling fan is positioned downstream of the filter slot relative to a flow of the intake air.

DETAILED DESCRIPTION

Figure 1:
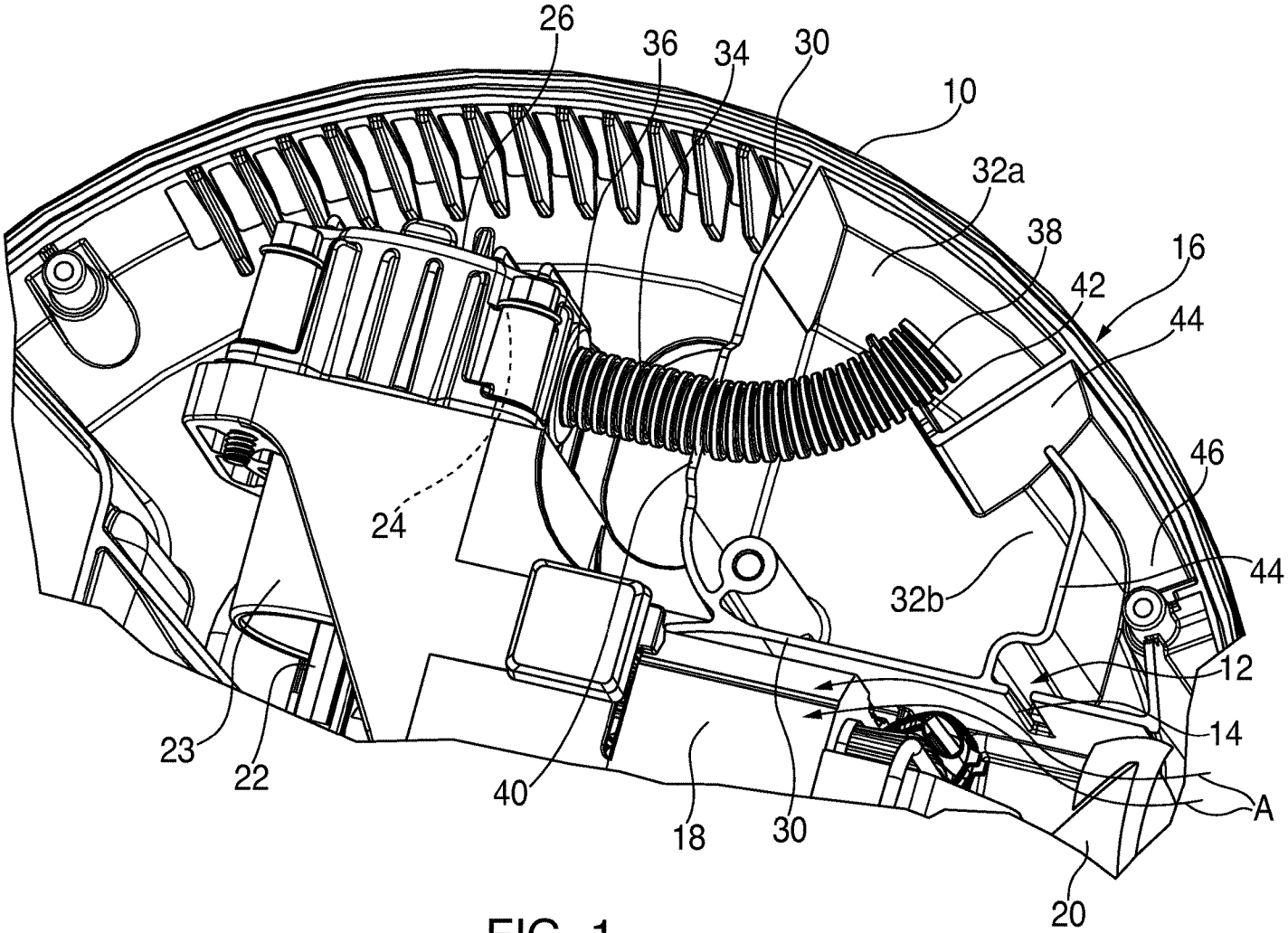
FIG. 1 is a partial vertical cut-away view showing a first embodiment of the present compressor shroud featuring an internal filter and an integral muffler.

Referring now to FIG. 1, the present compressor shroud is designated 10 and is configured for accommodating an inertial filter, generally designated 12, having a filter slot 14, and an integral muffler, generally designated 16. Both the inertial filter 12 and the integral muffler 16 are fully enclosed within the present compressor shroud 10, and are an integral part of the shroud. It is preferred that an electric motor 18 is provided for operation of a cooling or motor fan 20 for drawing an ambient air from outside of the compressor shroud 10. However, other power sources, such as gasoline engines, are contemplated. An exemplary flow of the ambient air through the shroud 10 is indicated by a graphic arrow A.

Powered by the motor 18, the fan 20 draws the ambient air A into the compressor shroud 10 such that the ambient air cools compressor components. During an intake process initiated by a piston 22 reciprocating within a cylinder 23 under the action of the motor 18, air is drawn into a first muffler cavity 24 (shown hidden) of a cylinder head 26 as the piston approaches its bottom dead center position. The present integral muffler 16 is designed to reduce the magnitude of pressure wave pulsations entering muffler cavities via a first muffler tube, and also the noise caused by the pulsations.

This goal is achieved by including in the integral muffler 16 a cavity barrier 30 configured for defining and accommodating at least one second muffler cavity 32*a*, 32*b* within the compressor shroud 10. In a preferred embodiment, at least one second muffler cavity 32*a* is in fluid communication with the adjacent second muffler cavity 32*b* so that the intake air can travel from one cavity to the other.

A first muffler tube 34 is connected to the cylinder head 26 at a first end 36, and an opposite, second end 38 is inserted into an opening 40 of the cavity barrier 30 in fluid communication with the cylinder head. As a result, inlet air generated by the intake stroke of the compressor is drawn into the cylinder head 26. As shown, the tube 34 is preferably corrugated.

In a preferred embodiment, a tube holder 42 is provided in one of the second muffler cavities 32*a*, 32*b* for securely holding the second end 38 of the first muffler tube 34 such as by clamping action by complementary upper and lower members, or by a friction fit. Each second muffler cavity 32*a* can be defined by an inner surface of the compressor shroud 10, an inner surface of the cavity barrier 30, and at least one divider wall or baffle 44. However, it is also contemplated that the second muffler cavity 32*b* can be defined by the inner surface of the cavity barrier 30, and at least one baffle 44. Each divider wall or baffle 44 is an integral part of the shroud 10, and extends either from the inner surface of the compressor 15 shroud or from the inner surface of the cavity barrier 30_for forming an expansion chamber for reducing the pulsation noise of the intake air.

Although two second muffler cavities 32*a*, 32*b* are shown for illustration purposes, any number of second muffler cavities is contemplated to suit the situation. Further, any suitable shape and arrangement of the baffles 44 is also contemplated for different applications. A second muffler tube or channel 46 having the filter slot 14 is provided in one of the second muffler cavities 32*b* such that the first muffler tube 34 and the second muffler tube 46 occupy different second muffler cavities 32*a*, 32*b*. For example, the first muffler tube 34 can occupy the upper second muffler cavity 32*a*, and the second muffler tube 46 can occupy the lower second muffler cavity 32*b*.

The second muffler tube 46 is defined by the inner surface of the compressor shroud 10, the inner surface of the cavity barrier 30, and the at least one baffle 44. In one embodiment, the intake air travels sequentially from the inertial filter slot 14 through the second muffler tube 46 to the lower second muffler cavity 32*b*, to the upper second muffler cavity 32*a* through the first muffler tube 34 and into the head 26. As discussed above, this type of muffler configuration generates about ten times larger muffler cavity at a significantly lower cost, and thus provides more efficient and compact muffling than conventional compressor shrouds.

In operation, the inertial filter 14 requires high speed air, provided by the motor fan 20, to pass by the slot. As the compressor enters its intake mode, and air is drawn into the slot 14, the denser dust and particulate contaminants cannot turn quickly enough to enter the narrow slot. However, the less dense air is able to make the turn into the slot 14 and provides clean air for the compressor.

Another important aspect of the present compressor shroud 10 is that the cooling fan 20 is positioned upstream of the filter slot 14 relative to the flow of the ambient air A. In this configuration, both the inertial filter 12 and the muffler 16 are seamlessly integrated together in the compressor shroud 10 without having to introduce any additional components for the filter or the muffler.

Figure 2:
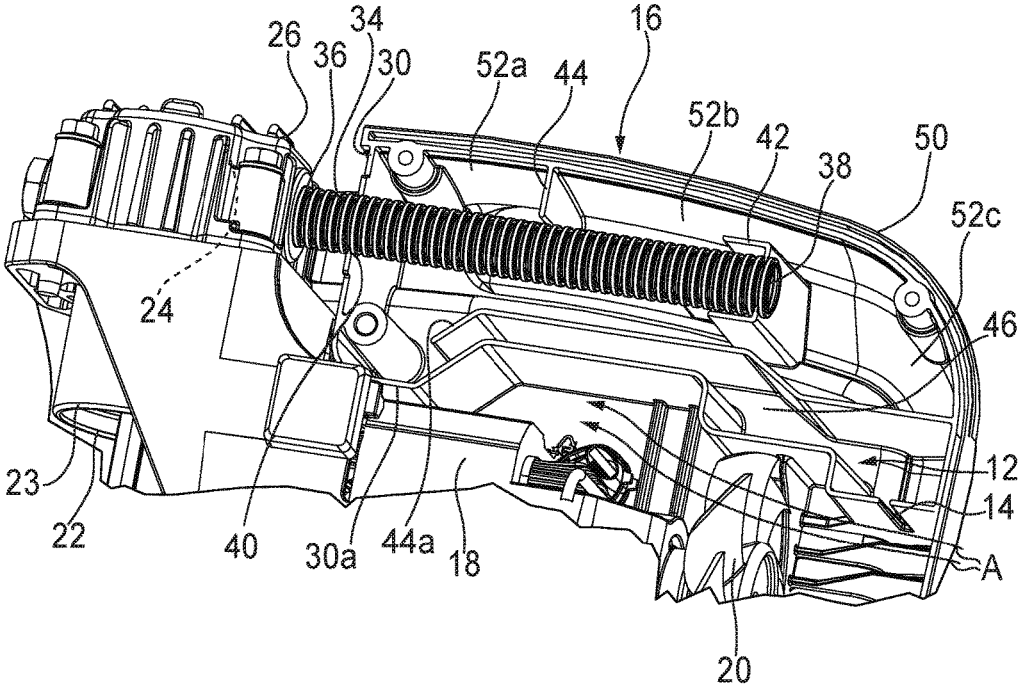
FIG. 2 is a partial vertical cut-away view showing a second embodiment of the present compressor shroud of FIG. 1.

Referring now to FIG. 2, another embodiment of the present compressor shroud 10 is designated 50. Components shared with the shroud 10 are designated with identical reference numbers. A major difference featured in the shroud 50 is that the cooling fan 20 is positioned downstream of the filter slot 14 relative to the flow of the ambient air A. Also, the shroud 50 has three second muffler cavities, such as an upper second muffler cavity 52*a*, a middle second muffler cavity 52*b*, and a lower second muffler cavity 52*c*.

In this embodiment, the second end 38 of the first muffler tube 34 is disposed in the lower second muffler cavity 52*c*. Thus, a longitudinal length of the first muffler tube 34 is longer than the length of the first muffler tube in the FIG. 1 embodiment. Another difference is that the tube holder 42 is disposed between the middle second muffler cavity 52*b* and the lower second muffler cavity 52*c* such that the inlet air travels sequentially from the inertial filter slot 14 through the second muffler tube 46 to the upper second muffler cavity 52*a*, to the middle second muffler cavity 52*b*, to the lower second muffler cavity 52*c*, through the first muffler tube 34 and into the compressor head 26.

Yet another important difference of the present compressor shroud 50 is that the second muffler tube 46 is substantially horizontally disposed relative to a longitudinal axis of the cooling fan 20, whereas the second muffler tube in the FIG. 1 embodiment is substantially vertically disposed relative to the longitudinal axis of the cooling fan. As is the case with the first muffler tube 34, a longitudinal length of the second muffler tube 46 is also longer than the length of the second muffler tube in the FIG. 1 embodiment. It is preferred that the second muffler tube 46 is defined by a divider wall or baffle 44*a* extending in generally parallel, spaced relation to a portion 30*a* of the cavity barrier 30 which is also generally parallel to the first muffler tube (FIG. 2), and is connected at one end to an inner surface of the compressor shroud 50.

In both of the embodiments described above, intake noise and low pressure pulsations travel at the speed of sound in the opposite direction from the cylinder head 26 back through the first muffler tube 34 and the muffler cavities. A feature of the present integral muffler 16 is that the relatively larger muffler cavity (32*a*, 32*b*) increases the frontal area of the pressure pulse and lowers the pulse pressure. Also, the second muffler tube 46 intercepts the relatively high surface area low pressure wave and transmits that lower and quieter pulse to the ears of those individuals near the compressor.

While a particular embodiment of the present invention has been described herein, it will be appreciated by those skilled in the art that changes and modifications may be made thereto without departing from the present disclosure in its broader aspects.

What is claimed is:

1. A pneumatic compressor, comprising:

a cylinder head having a first muffler cavity for drawing an intake air;

a compressor shroud including an inertial filter having a filter slot;

an integral muffler;

at least one second muffler cavity defined by a cavity barrier and forming part of said integral muffler, said at least one second muffler cavity including upper, middle and lower second muffler cavities;

a first muffler tube forming part of said integral muffler and located in said at least one second muffler cavity, wherein the first muffler tube sequentially passes through the upper second muffler cavity, the middle second muffler cavity, and the lower second muffler cavity the inertial filter and the integral muffler being integrally formed within the compressor shroud; and a second muffler tube having the filter slot, said second muffler tube defined in said compressor shroud by a baffle located between said first muffler tube and a portion of said cavity barrier extending generally parallel to said first muffler tube;

said at least one second muffler cavity, said filter slot and said first muffler tube are arranged within said compressor shroud so that the intake air travels through said filter slot, into said second muffler tube, into said upper second muffler cavity, through said middle second muffler cavity, to said lower second muffler cavity and then through said first muffler tube, and into said first muffler cavity in said cylinder head.

2. The compressor of claim 1, wherein a cooling fan is positioned either upstream or downstream of the filter slot relative to a flow of the intake air.

3. The compressor of claim 1, wherein the cavity barrier is configured for defining said at least one second muffler cavity within the compressor shroud.

4. The compressor of claim 3, wherein the at least one second muffler cavity is defined by an inner surface of the cavity barrier, and at least one divider wall.

5. The compressor of claim 3, further comprising at least one divider wall being an integral part of the compressor shroud and extending from at least one of an inner surface of the compressor shroud and an inner surface of the cavity barrier for forming an expansion chamber.

6. The compressor of claim 3, wherein the upper second muffler cavity is in fluid communication with the middle and lower second muffler cavities, such that the intake air travels from said upper second muffler cavity to at least one of said middle and lower second muffler cavities.

7. The compressor of claim 3, wherein the at least one second muffler cavity is defined by an inner surface of the compressor shroud, an inner surface of the cavity barrier, and at least one divider wall.

8. The compressor of claim 3, wherein said first muffler tube is connected to the cylinder head at a first end, said first muffler tube being positioned in an opening of the cavity barrier, and an opposite second end of said first muffler tube located in said lower second muffler cavity and being in fluid communication with the cylinder head.

9. The compressor of claim 8, further comprising a tube holder being disposed in the at least one second muffler cavity, said tube holder securely holding the second end of the first muffler tube.

10. A pneumatic compressor, comprising:

a cylinder head having a first muffler cavity for drawing an intake air;

a compressor shroud including an inertial filter having a filter slot;

an integral muffler;

at least one second muffler cavity forming part of said integral muffler, said at least one second muffler cavity being defined by at least one baffle and at least one cavity barrier, said at least one second muffler cavity including an upper second muffler cavity, a middle second muffler cavity and a lower second muffler cavity;

a first muffler tube forming part of said integral muffler and located in said at least one second muffler cavity, wherein the first muffler tube sequentially passes through the upper second muffler cavity, the middle second muffler cavity, and the lower second muffler cavity;

a second muffler tube is substantially horizontally disposed relative to a longitudinal axis of a cooling fan between said first muffler tube and an adjacent, generally parallel portion of said at least one baffle;

the inertial filter and the integral muffler are integrally formed within the compressor shroud, and said filter slot and said first muffler tube are arranged within said compressor shroud so that the intake air travels through said filter slot through said second muffler tube, into said upper second muffler cavity, through said middle second muffler cavity, to said lower second muffler cavity and then through said first muffler tube and into said first muffler cavity in said cylinder head; and the cooling fan being positioned downstream of the filter slot relative to a flow of the intake air.

11. The compressor of claim 10, wherein said first muffler tube is connected to the cylinder head at a first end, and an opposite second end of the first muffler tube being inserted into the lower second muffler cavity, said opposite second end of said first muffler tube being in fluid communication with the cylinder head.

* * * * *